US005904252A

United States Patent [19]

Piwowar

[11] Patent Number: 5,904,252

[45] Date of Patent: May 18, 1999

[54] COLLECTORS DISPLAY

[76] Inventor: Daniel S. Piwowar, 7166 126th St. West, Apple Valley, Minn. 55124

[21] Appl. No.: 09/070,569

[22] Filed: Apr. 30, 1998

[51] Int. Cl.[6] ..... B65D 85/48

[52] U.S. Cl. ..... 206/778; 206/449; 220/780

[58] Field of Search ..... 206/778, 1.5, 449, 206/461, 468, 454, 453; 220/780, 789, 315

[56] References Cited

U.S. PATENT DOCUMENTS

| | | | |
|---|---|---|---|
| 3,853,237 | 12/1974 | Marchant | 220/780 |
| 4,676,008 | 6/1987 | Armstrong | 206/454 |
| 5,464,095 | 11/1995 | Lacayo | 206/449 |
| 5,509,534 | 4/1996 | Taravella et al. | 206/587 |

*Primary Examiner*—Paul T. Sewell

*Assistant Examiner*—Nhan Lam

[57] ABSTRACT

A new collectors display for displaying a collection of die-cast cars. The inventive device includes an elongated protective shield having a generally U-shaped cross-section. The protective shield has open upper and lower ends. The protective shield includes an outer clear panel and a pair of rearwardly extending clear side panels. Each of the side panels have notches formed therein inwardly of free ends thereof. An elongated rear panel is dimensioned for being received between the notches of the side panels of the protective shield. The rear panel has inwardly curved side edges disposed interiorly of the protective shield. The inwardly curved side edges slidably receive cardboard edges of a blister pack therein. The rear panel has a pair of mounting apertures therethrough downwardly of an upper edge thereof.

4 Claims, 2 Drawing Sheets

COLLECTORS DISPLAY

BACKGROUND OF THE INVENTION

1. Field of the Invention

The present invention relates to protective displays and more particularly pertains to a new collectors display for displaying a collection of die-cast cars.

2. Description of the Prior Art

The use of protective displays is known in the prior art. More specifically, protective displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art protective displays include U.S. Pat. No. 5,370,223 to Leicht, Jr.; U.S. Pat. No. 5,379,892 to Reams et al.; U.S. Pat. No. 5,251,745 to Repp et al.; U.S. Pat. No. 5,207,717 to Manning; U.S. Pat. No. 5,168,988 to Johnston; and U.S. Pat. No. Des. 348,365 to Johnson.

While these devices fulfill their respective, particular objectives and requirements, the aforementioned patents do not disclose a new collectors display. The inventive device includes an elongated protective shield having a generally U-shaped cross-section. The protective shield has open upper and lower ends. The protective shield includes an outer clear panel and a pair of rearwardly extending clear side panels. Each of the side panels have notches formed therein inwardly of free ends thereof. An elongated rear panel is dimensioned for being received between the notches of the side panels of the protective shield. The rear panel has inwardly curved side edges disposed interiorly of the protective shield. The inwardly curved side edges slidably receive cardboard edges of a blister pack therein. The rear panel has a pair of mounting apertures therethrough downwardly of an upper edge thereof.

In these respects, the collectors display according to the present invention substantially departs from the conventional concepts and designs of the prior art, and in so doing provides an apparatus primarily developed for the purpose of displaying a collection of die-cast cars.

SUMMARY OF THE INVENTION

In view of the foregoing disadvantages inherent in the known types of protective displays now present in the prior art, the present invention provides a new collectors display construction wherein the same can be utilized for displaying a collection of die-cast cars.

The general purpose of the present invention, which will be described subsequently in greater detail, is to provide a new collectors display apparatus and method which has many of the advantages of the protective displays mentioned heretofore and many novel features that result in a new collectors display which is not anticipated, rendered obvious, suggested, or even implied by any of the prior art protective displays, either alone or in any combination thereof.

To attain this, the present invention generally comprises an elongated protective shield having a generally U-shaped cross-section. The protective shield has open upper and lower ends. The protective shield includes an outer clear panel and a pair of rearwardly extending clear side panels. Each of the side panels have notches formed therein inwardly of free ends thereof. An elongated rear panel is dimensioned for being received between the notches of the side panels of the protective shield. The rear panel has inwardly curved side edges disposed interiorly of the protective shield. The inwardly curved side edges slidably receive cardboard edges of a blister pack therein. The rear panel has a pair of mounting apertures therethrough downwardly of an upper edge thereof. A plurality of separator panels are slidably received between the inwardly curved side edges of the rear panel. The separator panels are positionable between blister packs. A pair of release pins are removably received within the notches of the side panels inwardly of the open upper and lower ends thereof. The release pins preclude the inadvertent removal of the elongated rear panel from the protective shield.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collectors display apparatus and method which has many of the advantages of the protective displays mentioned heretofore and many novel features that result in a new collectors display which is not anticipated, rendered obvious, suggested, or even implied by any of the prior art protective displays, either alone or in any combination thereof.

It is another object of the present invention to provide a new collectors display which may be easily and efficiently manufactured and marketed.

It is a further object of the present invention to provide a new collectors display which is of a durable and reliable construction.

An even further object of the present invention is to provide a new collectors display which is susceptible of a low cost of manufacture with regard to both materials and labor, and which accordingly is then susceptible of low prices of sale to the consuming public, thereby making such collectors display economically available to the buying public.

Still yet another object of the present invention is to provide a new collectors display which provides in the apparatuses and methods of the prior art some of the advantages thereof, while simultaneously overcoming some of the disadvantages normally associated therewith.

Still another object of the present invention is to provide a new collectors display for displaying a collection of die-cast cars.

Yet another object of the present invention is to provide a new collectors display which includes an elongated protective shield having a generally U-shaped cross-section. The protective shield has open upper and lower ends. The protective shield includes an outer clear panel and a pair of rearwardly extending clear side panels. Each of the side panels have notches formed therein inwardly of free ends thereof. An elongated rear panel is dimensioned for being received between the notches of the side panels of the protective shield. The rear panel has inwardly curved side edges disposed interiorly of the protective shield. The inwardly curved side edges slidably receive cardboard edges of a blister pack therein. The rear panel has a pair of mounting apertures therethrough downwardly of an upper edge thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
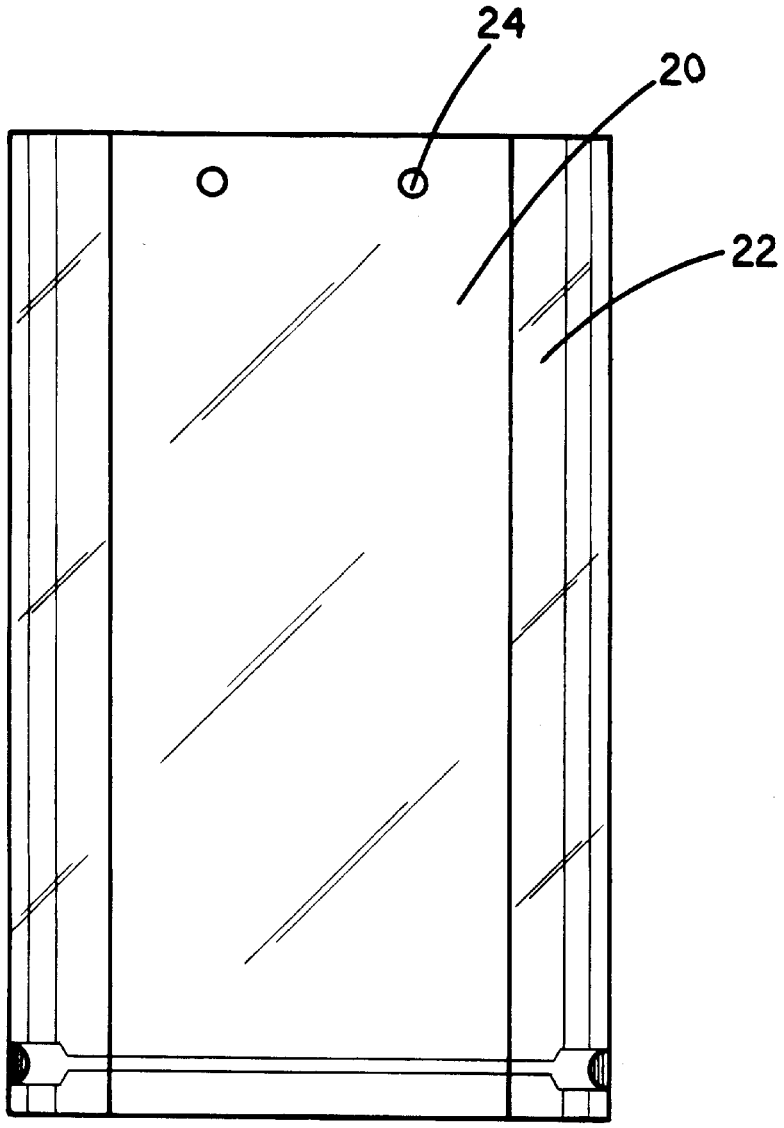
FIG. 1 is a front view of a new collectors display according to the present invention.
Figure 2:
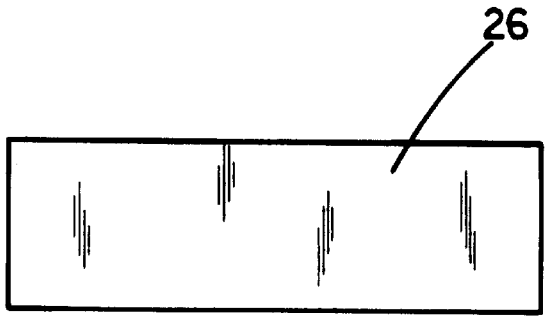
FIG. 2 is a front view of the separator panel of present invention.
Figure 3:
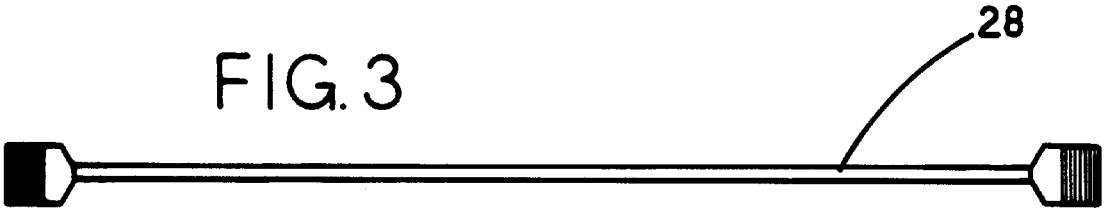
FIG. 3 is a front view of the release pin of the present invention.
Figure 4:
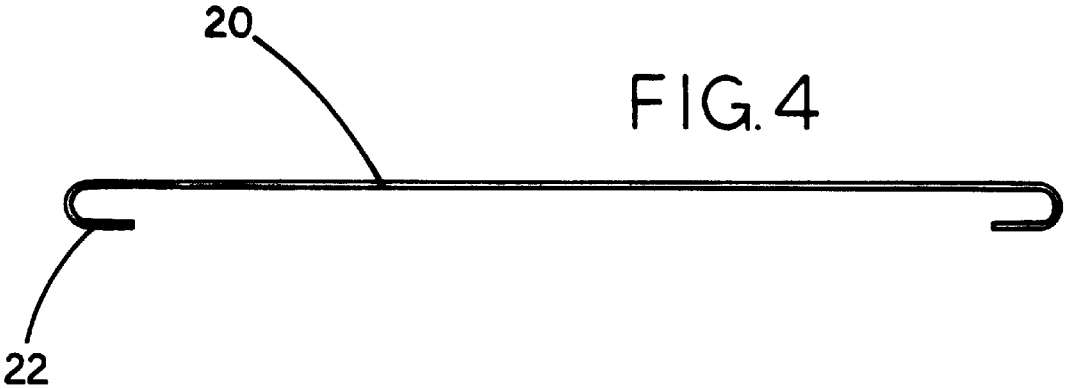
FIG. 4 is a top plan view of the rear panel of the present invention.
Figure 5:
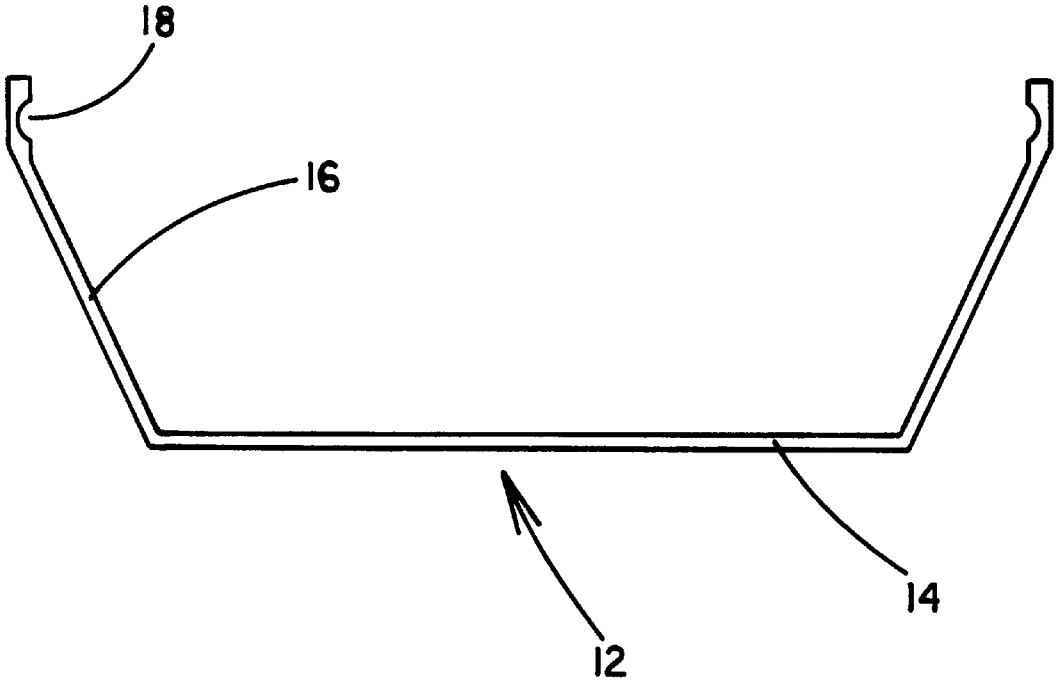
FIG. 5 is a top plan view of the protective shield of the present invention.

With reference now to the drawings, and in particular to FIGS. 1 through 5 thereof, a new collectors display embodying the principles and concepts of the present invention and generally designated by the reference numeral 10 will be described.

As best illustrated in FIGS. 1 through 5, the collectors display 10 comprises an elongated protective shield 12 having a generally U-shaped cross-section. The protective shield 12 has open upper and lower ends. The protective shield 12 includes an outer clear panel 14 and a pair of rearwardly extending clear side panels 16. Each of the side panels 16 have notches 18 formed therein inwardly of free ends thereof.

An elongated rear panel 20 is dimensioned for being received between the notches 18 of the side panels 16 of the protective shield 12. The rear panel 20 has inwardly curved side edges 22 disposed interiorly of the protective shield 12. The inwardly curved side edges 22 slidably receive cardboard edges of a blister pack therein. The rear panel 20 has a pair of mounting apertures 24 therethrough downwardly of an upper edge thereof.

A plurality of separator panels 26 are slidably received between the inwardly curved side edges 22 of the rear panel 20. The separator panels 26 are positionable between blister packs.

A pair of release pins 28 are removably received within the notches 18 of the side panels 16 inwardly of the open upper and lower ends thereof. The release pins 28 preclude the inadvertent removal of the elongated rear panel 20 from the protective shield 12.

In use, the present invention could be used to display cars and would also serve as a protective unit. The present invention is designed to hold a toy car that has not been removed from the blister pack packaging. The inwardly curved side edges 22 of the rear panel 20 would grip and protect the cardboard sides of the packaging. To use the present invention, the collector could insert the blister pack at the top of the rear panel 20. The inwardly curved side edges 22 would allow the package to slide downwards, The separator panels 26 could be used between each package, allowing many cars to be displayed. The apertures 24 in the rear panel 20 allow the present invention to be hung on a wall. Once the rear panel 20 is full, the protective shield 12 can receive the rear panel 20 between its notches 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new collectors display for displaying a collection of die-cast cars comprising, in combination:

an elongated protective shield having a generally U-shaped cross-section, the protective shield having open upper and lower ends, the protective shield including an outer clear panel and a pair of rearwardly extending clear side panels, each of the side panels having notches formed therein inwardly of free ends thereof;

an elongated rear panel dimensioned for being received between the notches of the side panels of the protective shield, the rear panel having inwardly curved side edges disposed interiorly of the protective shield, the inwardly curved side edges slidably receiving cardboard edges of a blister pack therein, the rear panel having a pair of mounting apertures therethrough downwardly of an upper edge thereof;

a plurality of separator panels slidably received between the inwardly curved side edges of the rear panel, the separator panels being positionable between blister packs;

a pair of release pins removably received within the notches of the side panels inwardly of the open upper and lower ends thereof, the release pins precluding inadvertent removal of the elongated rear panel from the protective shield.

2. A new collectors display for displaying a collection of die-cast cars comprising, in combination:

an elongated protective shield having a generally U-shaped cross-section, the protective shield having open upper and lower ends, the protective shield including an outer clear panel and a pair of rearwardly extending clear side panels, each of the side panels having notches formed therein inwardly of free ends thereof; and an elongated rear panel dimensioned for being received between the notches of the side panels of the protective shield, the rear panel having inwardly curved side edges disposed interiorly of the protective shield, the inwardly curved side edges slidably receiving cardboard edges of a blister pack therein, the rear panel having a pair of mounting apertures therethrough downwardly of an upper edge thereof.

3. The collectors display as set forth in claim 2 and further including a plurality of separator panels slidably received between the inwardly curved side edges of the rear panel, the separator panels being positionable between blister packs.

4. The collectors display as set forth in claim 2 and further including a pair of release pins removably received within the notches of the side panels inwardly of the open upper and lower ends thereof, the release pins precluding inadvertent removal of the elongated rear panel from the protective shield.

* * * * *